US006840517B2

(12) United States Patent
Snow et al.

(10) Patent No.: US 6,840,517 B2
(45) Date of Patent: Jan. 11, 2005

(54) POKER GAME WITH BONUS PAYOUTS

(76) Inventors: Roger M. Snow, 221 Dark Forest Rd., Las Vegas, NV (US) 89123; Ofir Ventura, 3820 Topaz St., Las Vegas, NV (US) 89121

( * ) Notice: Subject to any disclaimer, the term of this patent is extended or adjusted under 35 U.S.C. 154(b) by 29 days.

(21) Appl. No.: 10/277,508

(22) Filed: Oct. 21, 2002

(65) Prior Publication Data

US 2004/0075215 A1 Apr. 22, 2004

(51) Int. Cl.[7] ..... A63F 1/00
(52) U.S. Cl. ..... 273/292; 274/309
(58) Field of Search ..... 273/292, 274, 273/309

(56) References Cited

U.S. PATENT DOCUMENTS

| | | | |
|---|---|---|---|
| 3,667,757 | A | 6/1972 | Holmberg |
| 4,836,553 | A | 6/1989 | Suttle et al. |
| 4,861,041 | A | 8/1989 | Jones et al. |
| 5,098,107 | A | 3/1992 | Boylan et al. |
| 5,265,882 | A | 11/1993 | Malek |

(List continued on next page.)

*Primary Examiner*—Derris H. Banks
*Assistant Examiner*—Dolores R. Collins

(74) *Attorney, Agent, or Firm*—Mark A. Litman & Associates, P.A.

(57) ABSTRACT

A method of playing a card game is performed by a player making at least an ante wager and a wager on a bonus event to enter the card game. An initial hand of X cards is dealt to the player making the at least an ante wager and the wager on a bonus event. A hand of X cards is dealt to the dealer. The player decides to continue or end play of the game, the decision exercised by making a play wager to continue the game or forfeiting the ante and wager on a bonus event, ending a round of play of the game for that player. If a play wager is made by the player, at least one more card is dealt to the player; the player forming a best hand of X cards; comparing the player's best hand of X cards of the player against a best hand for the dealer with the dealer's X cards. The ante, wager on the bonus event and play wager are resolved based upon ranking rules of the card game, wherein X is an integer of 2–7 cards, especially, 4, 5 or 6 cards, and a preferred number of additional cards dealt to each player who makes the play wager is 1. It is a particularly useful format where the dealer does not receive any cards beyond X cards, and X is 5. The method is best practiced when a bonus wager is made, and the bonus wager is always paid if the rank of a player's hand making the wager exceeds a predetermined bonus rank. The method also is best practiced where the rank of a player's hand must exceed a predetermined game rank for the player to qualify to win on the ante and the play wager. A desirable predetermined game rank is at least a pair, especially a pair of 3's, 4's, 5's, 6's or 7's. A preferred predetermined bonus rank is at least two pair.

45 Claims, 1 Drawing Sheet

U.S. PATENT DOCUMENTS 5,288,077 A 2/1994 Jones
5,288,082 A 2/1994 Marquez
5,356,140 A 10/1994 Dabrowski et al.
5,364,105 A 11/1994 Jones
5,377,993 A * 1/1995 Josephs ..... 463/12
5,382,025 A * 1/1995 Sklansky et al. ..... 273/292
5,395,120 A 3/1995 Malek
5,417,430 A 5/1995 Breeding
5,494,295 A * 2/1996 Potter et al. ..... 273/292
5,531,440 A 7/1996 Dabrowski et al.
5,639,092 A 6/1997 Macaisa
5,664,781 A 9/1997 Feola
5,678,821 A * 10/1997 Hedman ..... 273/292
5,685,774 A 11/1997 Webb
5,697,614 A 12/1997 Potter et al.
5,702,104 A 12/1997 Malek et al.
5,816,914 A 10/1998 Wichinsky
5,816,915 A 10/1998 Kadlic
5,839,730 A 11/1998 Pike
5,839,732 A * 11/1998 Guidi ..... 273/292
5,845,906 A * 12/1998 Wirth ..... 273/274
5,863,041 A 1/1999 Boylan et al.
5,921,550 A 7/1999 Awada
5,951,012 A * 9/1999 Feola ..... 273/292
5,975,529 A 11/1999 de Keller
5,997,002 A 12/1999 Goldman
6,042,118 A * 3/2000 Poitra ..... 273/292
6,056,641 A 5/2000 Webb
6,131,907 A 10/2000 Nucifora et al.
6,131,908 A * 10/2000 Palmer ..... 273/292
6,136,907 A * 10/2000 Sunamori et al. ..... 524/430
6,170,827 B1 1/2001 Lombardo et al.
6,206,373 B1 * 3/2001 Garrod ..... 273/292
6,206,374 B1 * 3/2001 Jones ..... 273/292
6,234,485 B1 5/2001 Perkins
6,237,916 B1 * 5/2001 Webb ..... 273/292
6,270,405 B1 8/2001 Ferguson
6,334,613 B1 1/2002 Yoseloff
6,345,823 B1 2/2002 Webb
6,371,867 B1 4/2002 Webb
6,416,407 B1 7/2002 Carrico et al.
6,425,823 B1 * 7/2002 Byrne ..... 463/16
6,511,068 B1 * 1/2003 Sklansky et al. ..... 273/237
6,575,464 B1 * 6/2003 Fertitta et al. ..... 273/274

* cited by examiner

POKER GAME WITH BONUS PAYOUTS

BACKGROUND OF THE INVENTION

1. Field of the Invention

The present invention relates to a method of playing a wagering game utilizing a number of standard rules and preferably a standard deck(s) of playing cards. More specifically, the method of the present invention is an enhancement to the game of poker that enables additional betting opportunities and the possibility of higher payout amounts.

2. Background of the Art

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involve continuous wagering opportunities for the players thus increasing player participation and excitement. Lastly, the games move fairly quickly to maintain action and activity. All of these factors have created games that are widely accepted and are widely known.

Wagering games have been described in many previous publications such as U.S. Pat. No. 5,364,105 and U.S. Pat. No. 5,288,077. Both of these patents outline the addition of a progressive jackpot component to a Twenty-One game wherein wagers are received for participation in this jackpot component and these wagers are accumulated over a period of time to create a large jackpot. Following completion of a hand, the players may win a jackpot payout based on the final hand received by the player.

Variations in wagering structures can also increase the excitement and acceptance of such wagering games. U.S. Pat. No. 5,417,430 discloses a poker game with an altered wagering scheme thus allowing the player the opportunity to compete for an additional prize or payout.

Other variations can be made to standard games to allow more player opportunity and involvement. U.S. Pat. No. 5,098,107 discloses a game wherein additional symbols are added to increase wagering opportunities. This allows the player the opportunity to place several wagers on different portions of the game while the game is being played. Somewhat similarly, U.S. Pat. No. 3,667,757 discloses a board game wherein the player is given choices regarding alternative strategies for play. Naturally the different strategies chosen have different payoff results. Unfortunately, this game is somewhat complicated and requires a considerable amount of time for the players to learn.

U.S. Pat. No. 5,839,730 describes a side bet game that may be included with the play of a game of Twenty-One. A player makes a side bet that certain predetermined arrangements of cards or events will occur, with the player receiving special bonuses or jackpots when those events occur. For example, the player's side bet wager may cover such predetermined arrangements of cards or events such as any pair, any pair of the same suit, cards of the same suit, pairs of 2's, pairs of 3's, straights, flushes, runs of 2's and 3's as described in U.S. Pat. No. 5,839,730 and the like. An important consideration in the design of the side bet game to be played in combination with the play of a game of Twenty-One is to have the play of the side bet game irrelevant to the play of a game of Twenty-One. For example, if a jackpot is won when a player obtains six consecutive deuces, every player with a knowledge of the probabilities in the play of Twenty-One would be likely to continue taking hits on a count of 10 with five straight deuces, whether or not the side bet was in play with the game of Twenty-One. The game is specifically designed so that the player will not be required to choose a playing strategy that is inconsistent with the generally accepted strategy of the base game.

Many variations in the play of poker-type games have also been introduced to increase the excitement and interest in the play of both table and video versions of poker. For example, in a video version of draw poker, U.S. Pat. Nos. 5,356,140 and 5,531,440 teach that after an initial wager, two distinct hands may be dealt, and the player may select between the two hands for continued play of the game. Only a single hand may be played.

Similarly, U.S. Pat. No. 5,816,915 describes a video poker gaming apparatus in which multiple hands are displayed on a screen and each of the hands is partially revealed (e.g., 1 or more cards, but less than all cards are displayed). The player then elects which one of the multiple displayed hands is to be played, and the draw poker game or stud poker game for that one hand proceeds to a resolution. Again, only a single hand of poker is played.

U.S. Pat. No. 5,863,041 describes Pai Gow Poker with an auxiliary game. In the ordinary play of Pai Gow Poker, seven cards are dealt to a player, and the player divides the hand into a five-card poker hand and a two-card poker hand. Each of the hands made by a player must beat equivalently created hands (five and two-card hands) dealt to the dealer. In addition to the normal play of Pai Gow Poker, a player has the option of placing a bonus bet. The bonus bet encompasses the attainment of hands of a predetermined rank and the award of bonuses for attaining those hands after the bonus bet.

U.S. Pat. Nos. 5,265,882; 5,395,120 and 5,702,104 teach a casino table card game apparatus and play in which each player's position is provided with three distinct card playing areas or lines. Cards are dealt to a player so that each player may play at least two distinct card games (e.g., from among Twenty-One, modified Draw Poker, and Baccarat). A player makes a first bet in at least two of the different player positions, and cards are dealt to each of those player positions. Different games are played with each separate set of hands, and the play of one game does not directly influence or affect the play of any other game.

Similarly, U.S. Pat. No. 5,639,092 describes a method of playing a casino table game having multiple casino games. Each player position is provided with distinct playing positions for the different games (such as blackjack, roulette, baccarat, poker and jackpot).

U.S. Pat. Nos. 5,494,295 and 5,697,614 describe a casino table card game and apparatus in which a player may select any number of predetermined hand ranking rules to apply to the play of a hand. A player is dealt an initial, partial hand, and the player then elects from that initial hand which set(s) of predetermined hand ranking rules apply to the hand. In a preferred game, the dealer receives two separate bank hands, one that utilizes the hand ranks of standard poker and one that utilizes the hand ranks of low-ball poker. Once each player has received four of his five cards, each player decides which of the dealer's two hands to play against, with the option of playing against both (as in selecting both ways in a Hi-Low poker game). Then each player receives their fifth, and last, card. At this point, the "bank" hands are exposed and each player's hand is compared to the specific "bank" hand, or hands, that they played against, winners are determined, and wagers are settled. The election of playing against a high rank hand, low rank hand or both ways, does not alter the strategy or selection of cards, as only the hand dealt to the player is utilized, without any replacement of cards coincident with play strategy.

U.S. Pat. No. 5,664,781 describes a method and apparatus for playing a poker-type card game. A number of different stud poker hands are dealt on a playing surface and players wager as to which will have the highest stud poker ranking. Game options include choosing the hand with the lowest rank instead of the highest rank. As each hand is fixed and there are no replacement cards, there can be no play of one hand that is influenced by the play of another hand.

U.S. Pat. No. 5,377,993 teaches a form of Twenty-One in which the player's hand and the dealer's hand may be combined after play of the Twenty-One game to try to achieve a predetermined poker hand rank. As the play of the underlying game of Twenty-One is completed before the poker game is initiated, the play of the poker game cannot influence the play of Twenty-One or vice-versa. U.S. Pat. No. 5,288,082 describes a method of playing double hand Marquez, a game in which multiple hand versions of Twenty-One are played with individual players being dealt five cards, the five cards being divided into a two-card front hand and a three-card back hand. The cards in the front hand and the back hand are arranged to make each hand as close to twenty-one as possible, without going over, while at the same time maximizing the value of the front hand with respect to the back hand so that the value of the front hand has a value closer to twenty-one, without exceeding twenty-one. The front hand of the bank player is compared to the front hand of the player and the back hand of the bank player is compared with the back hand of the player, respectively, to determine if the player wins or loses the hand. The play of the cards is intended to be automatic, with no skill involved, and the play of one hand should not interfere with the play of the other hand.

U.S. Pat. No. 6,170,827 describes another poker-type casino table card game. This game may be played at a table with as many as seven players competing against a dealer. The play of the game is fairly complex, with each player having both multiple hands and utilization of a dealer's card. One method of play is to provide each player with three cards, and the dealer is provided with four cards. The dealer's play of cards is predetermined, while the players may select their desired holding. Player's hands are competing directly against the dealer's hand in each of the hands made by the player and the dealer.

U.S. Pat. No. 6,334,613 describes a play of a hand of poker (either as a casino table card game or a video gaming apparatus or computer game), in which a partial hand is provided to a player after an initial wager. The actual hand of poker involves the potential for at least two distinct games of poker being playable from that partial hand. The player may then elect to play one or more of the potential games from at least two distinct games of poker available for play with that hand. The nature of the at least two distinct games is that at least two of the games which may be played from the partial hand require decisions to be made where a decision with regard to a election of play strategy in one poker game that is intended to have or assist in getting a positive outcome is likely to have a negative effect or comprises an adverse strategy in the play of the second game. Various pay tables are provided that differ from each other, with respect to each single game, depending upon whether the player elects to play a single game with the partial poker hand or elects to play at least two games with continued play of the partial poker hand.

U.S. Pat. Nos. 6,345,823 and 6,237,916 describe a three-card, four-card, or five-card poker game in which various wagers are available to be made on the play of each player's hand.

U.S. Pat. No. 6,416,407 describes a method of playing a multi-draw poker-like game in which a winning hand generates a payout to a player using a computer and a video screen that comprises:

(1) providing a first payout table defining a predetermined set of winning hands of different ranks and payout values selected from a single deck of cards, each card having a different face value and suit, and with the remaining hands from said deck not included within the predetermined set of winning hands not having any payout value;

(2) providing a second payout table defining a predetermined set of winning hands of different ranks and payout values selected from a single deck of cards, each card having a different face value and suit, with the second payout table having at least one payout value different from the payout value established in said first payout table, and with the remaining hands from said deck not included within said predetermined set of winning hands not having any payout value;

(3) registering a wager with the computer;

(4) generating and displaying on the video screen a visual representation of a first hand of five cards randomly selected from the single deck of cards;

(5) determining the rank the first hand with respect to the first payout table from the face value and suit of each represented card;

(6) enabling said player to terminate the game or to designate at least one of said represented cards for replacement;

(7) if said designation is registered, in response thereto replacing at least one designated card in said first hand with a corresponding number of other represented cards randomly generated from the remaining cards in said single deck and displayed on said video screen, the unreplaced cards from said first hand and said replacement cards forming a second hand of five cards, with said second hand replacing said first hand;

(8) determining the rank of said second hand with respect to said first payout table from the face value and suit of each represented card;

(9) giving said player the option of either terminating play and being paid according to said first payout table or of making an additional wager and continuing play;

(10) if said player chooses the option of making an additional wager and continuing play, enabling said player to designate at least one of said represented cards of said second hand for replacement;

(11) if said designation of replacement of said represented cards of said second hand for replacement is registered, in response thereto replacing at least one designated card in said second hand with a corresponding number of other represented cards randomly generated from the remaining cards in said single deck and displayed on said video screen, the unreplaced cards from said second hand and said replacement cards forming a third hand of five cards, with said third hand replacing said second hand;

(12) determining the rank said third hand with respect to the second payout table from the face value and suit of each represented card and thereafter terminating said game; and

(13) upon termination after said first, second, or third hand providing said predetermined payout to said player according to the value of the remaining hand of cards as defined by said first payout table for said first or second hand and as defined by said second payout table for said third hand;

whereby a player may make a wager and play a poker game similar to five card draw poker, but in which the player may have the option to make an additional wager and make an additional draw of cards.

The game of Caribbean Stud® poker is described in U.S. Pat. Nos. 4,836,553 and 4,861,041. That game basically comprises a card game in which a player and a dealer are each dealt five cards. If the dealer has a poker hand having a value less than Ace-King combination or better, the player automatically wins. If the dealer has a qualifying poker hand having a value of an Ace-King combination or better, then the higher of the player's or the dealer's hand wins. If the player wins, he may also receive a bonus payment depending on the poker rank of his hand. In the commercial play of the game, a side bet is usually required to allow a chance at a progressive jackpot. In Caribbean Stud® poker, it is the dealer's hand that must qualify. As the dealer's hand is partially concealed during play (usually only one card, at most, is displayed to the player before player wagering is complete), the player must always be aware that even ranked player hands can lose to a dealer's hand and no bonus will be paid out unless the side bet has been made, and then usually only to hands having a rank of a flush or higher.

Another very popular poker-style game is described in Webb, U.S. Pat. Nos. 5,685,774, 6,056,641 and 6,237,916 and is marketed under the product name Three Card Poker®. In this game, the player makes one or more bets against a dealer's hand and against a pay table. The dealer and players each receive three cards. Players may view their three card hand and fold on the bet against the dealer or place an additional bet. The poker hand ranking hierarchy is slightly different than in five card poker, because of the differences in the frequency of occurrence of certain hands. The dealer's hand must qualify with a Queen high or better in order for the player to win the game against the dealer.

Another poker variant played in private games is called "Pitch and Bitch" poker. The normal play of the game is for each player to ante (the dealer usually being only a random player at the game) and then each player receives five cards in stud fashion (e.g., a] one card down, the next four cards up; or b] one card down, three cards up, and then the last card down), with betting taking place after the second card, the third card, the fourth card and the fifth card. After all five cards have been dealt, any player may pay an amount (usually equal to the ante) to allow that player to discard a card and receive a replacement card, in the same manner as the card replaced (i.e., a replacement down card for an original down card and a replacement up card for an original up card. Another round of wagering then takes place after the replacement card has been offered (and accepted or declined) to each player.

The availability of additional or alternative games of play and especially poker with alternative features that give the player the perception of an edge over the house is desirable in the field to stimulate and maintain player interest.

SUMMARY OF THE INVENTION

A poker game is described that may be played as a wagered table game, a video game, a combined table and video game or as a practice wagering game executing on a personal computer. The underlying game comprises the player wagering an Ante and a Super Bonus bet (usually in equal amounts or with equal limits at the table) and then both the dealer and each player receiving an initial hand of cards. After viewing his cards, the player has an option of folding or placing an additional Play bet at least equal in value to the Ante to continue the game and receive at least one additional card. According to the invention, the dealer always plays the dealer's original hand, and the player plays a hand equal in count to the dealer's hand but with his best cards. To win in an element of play of the player versus the dealer, the player must qualify by having a hand of an equal card count to the dealer's hand with a minimum predetermined rank. Qualification can be determined before or after one or more additional cards are dealt to the player, at the option of the house. If the player qualifies and the player's qualifying hand exceeds the rank of the dealer's hand, the Ante and the Play bet are paid at one-to-one. A special bonus is paid, on hands of a rank of at least a predetermined minimum rank. The special bonus is always paid for qualifying hands even if the dealer's hand is of a higher rank than the player's hand. In the event that the player's hand is less than the predetermined minimum rank but it still beats the dealer, the Super Bonus bet pushes.

The extra card or cards given to the dealer, plus the opportunity to push on a bonus bet rather than just lose or win gives the player a perceived edge, or advantage over the house, not present in other games known in the art.

DETAILED DESCRIPTION OF THE INVENTION

Figure 1:
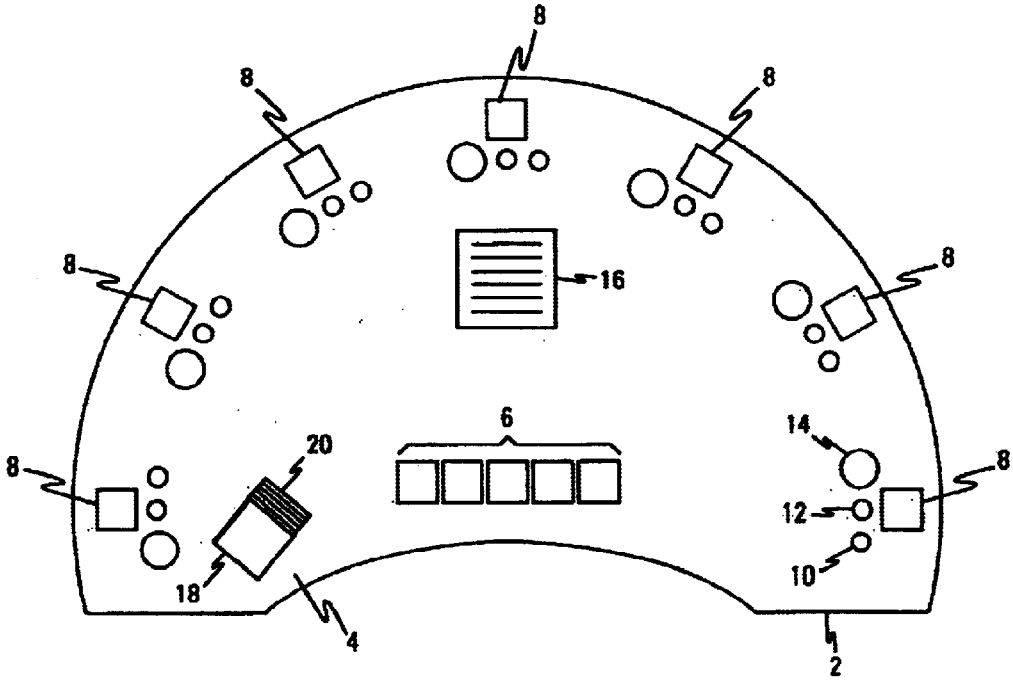
FIG. 1 shows an exemplary table layout for play of the poker game of the invention.

A poker-type game is played in the following manner, either as a table game, a video game or a computer-based or hand-held practice wagering game. The player must make an initial Ante bet to begin play of the game and/or a Super Bonus wager. In one form of the invention, the Super Bonus bet is a separate bet and is mandatory and equal in value to the Ante. The player and the dealer are initially dealt a like number of cards, with the player being able to view all of his cards and the player being able to view fewer than all of the dealer's cards (e.g., the player may be able to view zero cards, one card, two cards, etc. in the dealer's hand, up to all the dealer's cards but one), including seeing none of the dealer's cards. The preferred method of play comprises dealing five cards to each player, and to deal five cards to the dealer, face down, with zero cards or less preferably one card exposed in the dealer's hand. Preferably the game is played with both the dealer and the player receiving an initial hand of five cards per hand, although the use of virtually any number of cards, such as three-card hands, four-card hands, and even six-card or seven-card hands is possible. After the player receives the initial hand, the player determines whether, according to strategy or guessing, the player wants to continue competitive play of the hand. The player may elect to fold, in which case the Ante and Super Bonus bets are preferably retained by the house. In the alternative, all or part of the Super Bonus bet is returned to the player upon folding. If the player elects to stay competitive in the game, the player must make a Play wager. The Play wager may be, according to local rules, a fraction of the Ante, an amount equal to the Ante, or a multiple of the Ante (thus, less than, equal to or greater than the Ante). Limits on the amount of the Play wager are established in the game, and those limits, for example, may be at an amount equal to the Ante or a multiple of 1.5, 2.0, or 3.0 times the Ante. In one example of the invention, the play bet is equal to the ante. The house may require that at least an Ante be wagered, even when a Super Bonus wager is not placed to control the flow and hold in the game.

A general description of the game can be characterized as a method of playing a card game comprising a player making at least an Ante wager and a wager on a bonus event to enter the card game; dealing a) an initial hand of X cards to the player making the at least an Ante wager and the wager on a bonus event and b) a hand of X cards to a dealer; the player deciding to continue or end play of the game, the decision exercised by making a play wager to continue the game or forfeiting the Ante and pushing and/or forfeiting the wager on a bonus event, ending a round of play of the game for that player. If a Play wager is made by the player, dealing at least one more card to the player; the player forming a best hand with X cards; comparing the best hand of X cards of the player against a best hand for the dealer with the dealer's X cards; and resolving the Ante and Play wager based upon ranking rules of the card game, wherein X is an integer of 2–7 cards, especially, 4, 5 or 6 cards. It is a particularly useful format where the dealer does not receive any cards beyond X cards, and X is 5. Also, it is most preferred that each player receive only one additional card, although receipt of two or more cards is contemplated. Allowing further wagering opportunities to receive more than one card is also contemplated by the present invention. The method is best practiced when a mandatory bonus wager is made, and the bonus wager is always paid if the rank of a player's hand making the wager exceeds a predetermined minimum bonus ranking. The method also is best practiced where the rank of a player's hand must exceed a predetermined game rank for the player to "qualify" to win on the Ante and the Play wagers. A desirable predetermined game rank is at least a pair, especially a pair of 3's, 4's, 5's, 6's or 7's, a pair of fours being the most preferred qualifying hand in the base game. A preferred predetermined bonus rank is at least two pair.

When the player has elected to withdraw from the game, both the initial ante and/or the Super Bonus wager are collected by the house. Or, the ante is collected by the house and all of or a fraction of the Super Bonus is returned to the player. When the player has elected to remain in the game by placing the play wager, the player is dealt at least one additional card, usually a sixth card, while the dealer receives no additional cards beyond the original cards (usually five cards) that the dealer was dealt. The additional card or cards provides the player with a perceived advantage over the house. The player then constructs the best poker hand possible, using the same number of cards dealt to the dealer-e.g., usually a five-card poker hand. The rules of the game may allow for the best possible hand to be automatically provided by the dealer, or by means of automated equipment. That is, the player cannot accidentally place or call a hand with a value less than the optimal hand available from the cards. For example, the hand may contain five spades and a club that forms a pair with one of the spades. The player may inadvertently call a pair, failing to see the flush, and the house dealer and/or equipment will automatically correct the hand to a flush. This problem should not occur in a video version of the game where the processor would automatically read hands correctly, or in a table game equipped with equipment capable of reading and ranking the value of each hand.

The awards or losses can occur as at least as follows. When the player makes the play bet and the player's hand does not qualify (e.g., at least an Ace-King, at least a pair of 2's, at least a pair of 3's, at least a pair of 4's (preferred), at least a pair of 5's, at least a pair of 6's, at least a pair of 7's, etc. at the discretion of the house rules), the player loses all wagers (the ante, the Super Bonus wager, and the play wager). In another example of the invention, when the player places the play wager and the player does not qualify (in this example, all six cards are used to make the player Qualification determination), one or more of the bets are returned to the player. For example, the house may sweep the Ante and Play bets but return all or part of the Super Bonus bet to the player. Or the Ante and Super Bonus are swept and the Bet is returned. In a third example, the Bet and Super Bonus are swept and the Ante is returned to the player.

When the player's hand qualifies, and the dealer's hand exceeds the player's hand, the player loses at least the Ante and the Play wager. If the player's hand has a five-card (for example) poker ranking that meets the minimum standard for the Super Bonus, then the Super Bonus wager is paid to the player, even if the dealer's hand is higher in rank than the player's hand. If the dealer's hand exceeds the value of the players hand rank and the player's hand does not meet the minimum standard for a Super Bonus award (e.g., at least two pairs), then the player loses the Super Bonus wager in addition to the ante and the play wager.

The player wins, if he has placed a play wager in addition to at least the ante (and the Super Bonus wager, if that wager is not optional) if the player's hand is at least the qualifying rank (e.g., at least a pair of 4's according to the preferred embodiment) and the rank of the player's best hand (e.g., usually a five-card hand made from selecting five of the six cards controlled by the player) exceeds the rank of the dealer's five card hand. In this event, the player wins at least the Ante (e.g., one-to-one and may be higher, with bonuses in addition to or in place of the one-to-one win for exceptionally larger hands) and at least the Play wager (which is at least one-to-one and may be higher, with bonuses in addition to or in place of the one-to-one win for exceptionally larger hands). If the player has placed the Super Bonus wager and the player has a qualifying hand (e.g., at least a pair of 4's) but does not have a minimum Super Bonus hand (e.g., a minimum Super Bonus hand might be at least two pairs, at least two pairs with at least a pair of certain rank (e.g., at least a pair of 10's), at least three-of-a-kind, etc.), the player would lose the Super Bonus wager. If the player has placed the Super Bonus wager and the player has a qualifying hand (e.g., at least a pair of 4's) and has a minimum Super Bonus hand (as described above), then the player will win the Super Bonus wager, whether or not the player's hand rank is higher than the dealer's hand rank. If the player has a qualifying "play" hand (i.e., a pair of 4's) and beats the dealer's hand, but does not have a qualifying "bonus" hand, the Super Bonus is a push, in one preferred form of the invention. This feature reduces the number of times on the average the Super Bonus bet is lost, and is believed to be an attractive feature of the game, providing with the player the perception that he has a competitive edge over the house. A review of potential events in the play of the game will facilitate the understanding of the invention.

The optional strategy for a preferred form of the game (Player qualifies to play with a pair of 4's, Super Bonus bet is mandatory, dealer receives 5 cards and players receive a $6^{th}$ card when they make the play wager), dictates that the player should place the play bet when the initial five card hand includes a) a pair or better, b) four cards to a flush, c)

four cards to a straight, or d) no cards lower than 4. For purposes of illustration, the player in all of the examples below plays with a pair or better. It is to be understood that in the following examples, the player is playing according to any of the strategies described above, even though the tables illustrate the technique using just "pairs".

| WAGERS PLACED | DEALER'S HAND | PLAYER'S HAND | PLAYER ACTION | PLAY OUTCOME | BONUS OUTCOME |
|---|---|---|---|---|---|
| | | EVENT I | | | |
| ANTE | Immaterial | No Pairs | Fold | Loss | No Wager |
| | | EVENT II | | | |
| ANTE and BONUS WAGER | Immaterial | No Pairs | Fold | Loss | Loss |
| | | EVENT III | | | |
| ANTE | Immaterial | Pair of 4's | Play Wager | | No Wager |
| PLAY WAGER (PW) | Less than Pair | Pair of 4's (after 6th Card) | Play Wager | Win Ante, Win Play Wager | No Wager |
| | | EVENT IV | | | |
| ANTE | Pair of 10's | Pair of 6's | Play Wager | | No Wager |
| PLAY WAGER | Pair of 10's | Pair of 6's (after 6th Card) | Play Wager | Loss of Ante and PW | No Wager |
| | | EVENT V | | | |
| ANTE | Pair of 10's | Pair of 6's | Play Wager | | No Wager |
| PLAY WAGER | Pair of 10's | Two Pair (after 6th Card) | Play Wager | Player Wins Ante and PW | No Wager |
| | | EVENT VI | | | |
| ANTE | Immaterial | No Pairs | Fold | Loss | Loss |
| SUPER BONUS (SB) | Less than Pair | No Pairs | Fold | Loss | Loss |
| | | EVENT VII | | | |
| ANTE and PW and SB | Less Than Pair | Pair of 4's | PW | | |
| | Less than Pair | Pair of 4's | PW | Win Ante and PW | Push |
| | | EVENT VIII | | | |
| ANTE and PW | Immaterial | Pair of 6's | PW | | |
| SB | Less than Pair | Two Pairs | PW | Win Ante and Win PW | WIN SB |
| | | EVENT IX | | | |
| ANTE and PW | Immaterial | Pair of 6's | PW | | |
| SB | 3-of-a-kind | Two Pairs | PW | Loss of Ante and PW | WIN SB |
| | | EVENT X | | | |
| ANTE and PW | Immaterial | 3 Jacks | PW | | |
| SB | 3 × 6's | 3 Jacks | PW | Win Ante and Win PW | WIN SB |
| | | EVENT XI | | | |
| ANTE and PW | Immaterial | Pair of 4's | PW | | |
| SB | 3 × 6's | Pair of 4's | PW | Lose Ante and PW | Lose SB |

The abbreviation "PW" stands for Play Wager, and indicates that bet was made.
The abbreviation "SB" stands for the Super Bonus wager being placed.

Although in the examples above, the Super Bonus bet is lost when the player folds, in other forms of the invention, all or a portion of this bet can be returned to the player.

As can be seen from these event tables, the outcomes can be readily determined without complexity, which has been a shortcoming of many casino games with additional wagers. The play presented in the tables above is based upon a fundamental strategy that is recommended for play of the game, although in the examples, only strategy "d" below is illustrated. That simple strategy (with no dealer cards disclosed) comprises staying in the game and placing the Play Wager whenever a player has a) no cards lower than 4 (with the qualifying rank being at least a pair of 4's); b) four cards to a straight; c) four cards to a flush; or d) one pair (of any rank) or better. Pushes or wins are decided between the dealer and player based on all cards, but the $6^{th}$ card could be ignored if the house rule so provided. For example, the outcomes for the following player hands (PH) and dealer hands (DH), considering the $6^{th}$ card would be:

Dealer Win

DH 6, 6, K, J, 8 PH 6, 6, Q, J, 10, 8

The dealer wins because the remainder high cards of the dealer (after considering the pair of 6's) are higher than the remainder cards of the player.

Player Win

DH 7, 7, 10, 8, 4 PH 7, 7, J, 4, 3, 2

The player wins because the remainder high cards of the player (after considering the pair of 6's) are higher than the remainder cards of the dealer.

PUSH

DH J, J, K, 7, 3 PH J, J, K, 7, 3, 2

There is a push because the rank of cards in the five card hands of the player and dealer are identical and the sixth card does not improve the player's five-card hand rank. The house may provide a subsidiary rule that five card pushes are won by either the house or the player.

The payout tables for the Super Bonus element of the game may also be selected according to the suggestions and profit targets. Samples of various payout tables are shown in the following seven tables.

| Pay Table Example 1 | |
|---|---|
| ROYAL FLUSH | 500 TO 1 |
| STRAIGHT FLUSH | 50 TO 1 |
| FOUR OF A KIND | 30 TO 1 |
| FULL HOUSE | 8 TO 1 |
| FLUSH | 6 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 1.77% |

| Pay Table Example 2 | |
|---|---|
| ROYAL FLUSH | 500 TO 1 |
| STRAIGHT FLUSH | 50 TO 1 |
| FOUR OF A KIND | 20 TO 1 |
| FULL HOUSE | 7 TO 1 |
| FLUSH | 6 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 2.31% |

| Pay Table Example 3 | |
|---|---|
| ROYAL FLUSH | 500 TO 1 |
| STRAIGHT FLUSH | 50 TO 1 |
| FOUR OF A KIND | 20 TO 1 |
| FULL HOUSE | 7 TO 1 |
| FLUSH | 5 TO 1 |
| STRAIGHT | 4 TO 1 |
| THREE OF A KIND | 3 TO 1 |
| TWO PAIR | 1 TO 1 |
| Hit Frequency | 19.72% |

-continued

| Pay Table Example 3 | |
|---|---|
| Units | 2.81 |
| House Edge | 2.68% |

| Pay Table Example 4 | |
|---|---|
| ROYAL FLUSH | 500 TO 1 |
| STRAIGHT FLUSH | 50 TO 1 |
| FOUR OF A KIND | 20 TO 1 |
| FULL HOUSE | 6 TO 1 |
| FLUSH | 5 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 2.97% |

| Pay Table Example 5 | |
|---|---|
| ROYAL FLUSH | 200 TO 1 |
| STRAIGHT FLUSH | 50 TO 1 |
| FOUR OF A KIND | 30 TO 1 |
| FULL HOUSE | 8 TO 1 |
| FLUSH | 6 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 1.87% |

| Pay Table Example 6 | |
|---|---|
| ROYAL FLUSH | 200 TO 1 |
| STRAIGHT FLUSH | 50 TO 1 |
| FOUR OF A KIND | 20 TO 1 |
| FULL HOUSE | 8 TO 1 |
| FLUSH | 6 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 2.13% |

| Pay Table Example 7 | |
|---|---|
| ROYAL FLUSH | 200 TO 1 |
| STRAIGHT FLUSH | 50 TO 1 |
| FOUR OF A KIND | 20 TO 1 |
| FULL HOUSE | 7 TO 1 |
| FLUSH | 5 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 2.78% |

| Pay Table Example 8 | |
|---|---|
| ROYAL FLUSH | 200 TO 1 |
| STRAIGHT FLUSH | 50 TO 1 |
| FOUR OF A KIND | 20 TO 1 |
| FULL HOUSE | 6 TO 1 |
| FLUSH | 5 TO 1 |
| STRAIGHT | 4 TO 1 |
| THREE OF A KIND | 3 TO 1 |
| TWO PAIR | 1 TO 1 |
| Hit Frequency | 19.72% |
| Units | 2.81 |
| House Edge | 3.07% |

There are many variations that may be played in the game. One particular variant that is advantageous to the player is to allow the player to retain the Super Bonus wager when the player qualifies but does not attain at least the Super Bonus minimum hand for the Super Bonus award. This variation may extend to hands where either the player's hand beats the dealer's hand or the player's hand loses to the dealer's hand. For example, if the player's best hand (with a Super Bonus wager) after receiving the sixth card is a pair of 10's and the dealer's hand is a pair of 7's, the player retains the Super Bonus bet, even though the player did not get a Super Bonus award-winning hand. This betting format is different from that in many other games, such as Three Card Poker® and the like. In that game, a "Pair Plus" wager is made. If the player attains at least a pair, the player is paid off on the Pair Plus wager. If the player does not attain at least a pair (irrespective of whether the player's hand is of higher rank than the dealer's hand), the player forfeits the wager. The Pair Plus wager in Three Card™ poker is therefore always at risk, as compared to this option in the play of the Super Bonus wager.

Another similar variant would be when the player qualifies, does not have a Super Bonus ranking hand, but does not have a hand of higher rank than the dealer. The fact of qualifying, whether or not the player's hand loses to the dealer's hand, may be used as a reprieve on the Super Bonus wager. This is not a preferred method of play, but is an option within the control of the house selection. By increasing the player retention of the Super Bonus wager, other payout factors may be modified to control the house edge, while making the Super Bonus wager clearly safer and more attractive in the eyes of the player. The player would therefore be willing to accept lower payout rates for a safer Super Bonus wager, increasing play card house win on this wager. Again, the Super Bonus wager is preferably always paid, regardless of the relationship of the dealer's hand and the player's hand.

Another variant is the determination of when a player's hand qualifies with regard to the basic qualifying event (not the minimum Super Bonus rank). As in certain other games where a qualifying or minimum hand may be needed to play (e.g., Jacks or Better), a player may be dealt a qualifying hand, yet find that the strategic move is to discard the qualifying feature, while trying for a better hand. For example, an initial five card hand could be 10-J-Q-K of hearts and the K of spades. The strategic move is to discard the king of spades, hoping for a straight flush or royal flush. The qualifying of hands in the ante game, play wager and the underlying game in a preferred form of the invention need be determined only after all six cards have been dealt to a player. There is no requirement that a player's hand must qualify before placing the play wager and receiving the sixth card. The fact that the player retains all six cards in a preferred form of the game, also avoids the potential for adverse rank effects in having to break up on value of a hand to pursue a higher value.

Yet another variant includes dealing the dealer and player a number of cards (3 or 5, for example) and dealing each player more than one (for example, 2) extra card if the player makes the play bet. In a second preferred example of the invention, the dealer and players initially receive five cards, and the player's who make the play wager get two additional cards. Players make their best five card hand from the seven cards. The additional card gives the player a perceived greater advantage over the house.

FIG. 1 shows a gaming table 2 for use with one example of the game of the invention. The table 2 shows a playing surface 4 having a dealer's card position 6 and 7 player's hand positions 8. In front of each player's card position 8 are shown Ante wager positions 10, Play wager positions 12, and Super Bonus wager positions 14. Also shown is an extra card position 15. Also shown on the gaming table are a rules/pay table sheet 16, card shuffler 18 and playing cards to be dealt 20.

As with any other casino game or video game, additional variations are within the skill of those in the art. Variations might include, by way of non-limiting examples, varying the required and/or allowed maximum amounts of the wagers, varying the allowed relationship of the various wagers (the ante, the play wager and the Super Bonus wager), using more than one deck (especially in electronic versions, where a single deck could be used for each hand played, so that multiple hands may be played against a single dealer's hand, or multiple dealer's hands could be played against a single player's hand), dealing more than one additional card to the player when they make a play bet, changing game and bonus qualification hand rankings and the like. These variations are within the skill of those in the art and within the scope of the following claims to the invention. Tables formatted to the design and play of this game may also be varied, without deviating from the scope of the invention.

What is claimed:

1. A method of playing a card game comprising:

a player making at least an ante to enter the playing card game;

dealing an initial hand of X cards to at least one player and a hand of X cards to a dealer;

the player deciding if the player wants to continue play of the game, the decision exercised by making a play wager to continue the game and otherwise folding the player's hand and losing the ante and ending a round of play of the game for that player;

if a play wager is made by the player, dealing at least one more card to the player;

the player forming a best hand of X cards from the X+cards;

comparing the best hand of the player against a best hand for the dealer with the dealer's X cards; and resolving the ante and play wager based upon ranking rules of the card game, wherein X is a single integer selected from the group consisting an integer of 2, 3, 4, 5, 6 or 7.

2. The method of claim 1 wherein the dealer does not receive any cards beyond X cards.

3. The method of claim 2 wherein X is 5.

4. The method of claim 2 wherein a bonus wager is made, the bonus wager always being paid if the rank of a player's hand making the wager exceeds a predetermined bonus rank.

5. The method of claim 3 wherein a bonus wager is made, the bonus wager always being paid if the rank of a player's hand making the wager meets or exceeds a predetermined minimum bonus rank.

6. The method of claim 3 wherein the rank of a player's hand must be at least a minimum predetermined game rank for the player to qualify to win on the ante and the play wager.

7. The method of claim 5 wherein the rank of a player's hand must be at least a predetermined minimum game rank for the player to qualify to win on the ante and the play wager.

8. The method of claim 5 wherein the predetermined minimum game rank is at least a pair.

9. The method of claim 5 wherein the predetermined minimum game rank is at least a pair of 4's.

10. The method of claim 5 wherein the predetermined bonus rank is at least two pair.

11. The method of claim 5 where the pay table for the bonus wager is

| | |
|---|---|
| ROYAL FLUSH | At least 200 TO 1 |
| STRAIGHT FLUSH | At least 50 TO 1 |
| FOUR OF A KIND | At least 20 TO 1 |
| FULL HOUSE | At least 6 TO 1 |
| FLUSH | At least 5 TO 1 |
| STRAIGHT | At least 4 TO 1 |
| THREE OF A KIND | At least 3 TO 1 |
| TWO PAIR | At least 1 TO 1. |

12. The method of claim 5 wherein both the ante and the bonus wager must be made by a player to enter the card game.

13. The method of claim 7 wherein the predetermined minimum game rank is at least a pair.

14. The method of claim 7 wherein the predetermined minimum game rank is at least a pair of 4's.

15. The method of claim 7 wherein the predetermined bonus rank is at least two pair.

16. The method of claim 15 wherein both the ante and the bonus wager must be made by a player to enter the card game.

17. The method of claim 7 where the pay table for the bonus wager is

| | |
|---|---|
| ROYAL FLUSH | At least 200 TO 1 |
| STRAIGHT FLUSH | At least 50 TO 1 |
| FOUR OF A KIND | At least 20 TO 1 |
| FULL HOUSE | At least 6 TO 1 |
| FLUSH | At least 5 TO 1 |
| STRAIGHT | At least 4 TO 1 |
| THREE OF A KIND | At least 3 TO 1 |
| TWO PAIR | At least 1 TO 1. |

18. The method of claim 7 wherein both the ante and the bonus wager must be made by a player to enter the card game.

19. The method of claim 8 wherein the predetermined bonus rank is at least two pair.

20. The method of claim 19 where the pay table for the bonus wager is

| | |
|---|---|
| ROYAL FLUSH | At least 200 TO 1 |
| STRAIGHT FLUSH | At least 50 TO 1 |
| FOUR OF A KIND | At least 20 TO 1 |
| FULL HOUSE | At least 6 TO 1 |
| FLUSH | At least 5 TO 1 |
| STRAIGHT | At least 4 TO 1 |
| THREE OF A KIND | At least 3 TO 1 |
| TWO PAIR | At least 1 TO 1. |

21. The method of claim 8 wherein both the ante and the bonus wager must be made by a player to enter the card game.

22. The method of claim 9 wherein the predetermined bonus rank is at least two pair.

23. The method of claim 9 wherein both the ante and the bonus wager must be made by a player to enter the card game.

24. The method of claim 22 where the pay table for the bonus wager is

| | |
|---|---|
| ROYAL FLUSH | At least 200 TO 1 |
| STRAIGHT FLUSH | At least 50 TO 1 |
| FOUR OF A KIND | At least 20 TO 1 |
| FULL HOUSE | At least 6 TO 1 |
| FLUSH | At least 5 TO 1 |
| STRAIGHT | At least 4 TO 1 |
| THREE OF A KIND | At least 3 TO 1 |
| TWO PAIR | At least 1 TO 1. |

25. The method of claim 22 wherein both the ante and the bonus wager must be made by a player to enter the card game.

26. The method of claim 1 wherein X is 5, and the number of additional cards dealt to each player is 1.

27. The method of claim 26 wherein a bonus wager is made, the bonus wager always being paid if the rank of a player's hand making the wager exceeds a predetermined bonus rank.

28. The method of claim 1 wherein a bonus wager is made, the bonus wager always being paid if the rank of a player's hand making the wager meets or exceeds a predetermined minimum bonus rank.

29. The method of claim 7 wherein the predetermined bonus rank is at least two pair.

30. The method of claim 29 wherein both the ante and the bonus wager must be made by a player to enter the card game.

31. The method of claim 28 wherein both the ante and the bonus wager must be made by a player to enter the card game.

32. The method of claim 1 wherein the rank of a player's hand must be at least a minimum predetermined game rank for the player to qualify to win on the ante and the play wager.

33. The method of claim 1 and further comprising the step of making a bonus wager, wherein if the player obtains a qualifying bonus hand, the player is paid a payout, and wherein if the player does not obtain a qualifying hand, but beats the dealer hand, the wager is returned to the player, and if the hand does not qualify and is lower in rank than the dealer's hand, the bonus bet is taken by the house.

34. The method of claim 1, wherein standard five-card poker rankings are used in comparing hands.

35. A method of playing a card game comprising:

a player making at least an ante wager and a wager on a bonus event to enter the card game;

dealing a) an initial hand of exactly X cards to the player making the at least an ante wager and the wager on a bonus event and b) a hand of exactly X cards to a dealer;

the player deciding to continue or end play of the game, the decision exercised by making a play wager to continue the game or forfeiting the ante and wager on a bonus event, ending a round of play of the game for that player;

if a play wager is made by the player, dealing at least one more card to the player;

the player forming a best hand of X cards from the X+1 cards;

comparing the best hand of X cards of the player against a best hand for the dealer with the dealer's X cards; and resolving the ante, wager on a bonus event and play wager based upon rules of the card game, wherein X is a single integer selected from the group consisting of 4, 5 and 6.

36. The method of claim 35 wherein the dealer does not receive any cards beyond X cards, and X is 5.

37. The method of claim 36 wherein a bonus wager is made, the bonus wager always being paid if the rank of a player's hand making the wager exceeds a predetermined minimum bonus rank.

38. The method of claim 36 wherein the rank of a player's hand must exceed a predetermined minimum game rank for the player to qualify to win on the ante and the play wager.

39. The method of claim 38 wherein the predetermined game rank is at least a pair.

40. The method of claim 39 wherein the predetermined game rank is at least a pair of 4's.

41. The method of claim 40 wherein the predetermined bonus rank is at least two pair.

42. The method of claim 39 wherein the predetermined bonus rank is at least two pair.

43. The method of claim 35, wherein the bonus bet is a push if a rank of the player's hand does not meet a minimum ranking to qualify for a bonus payout and the hand exceeds a rank of the dealer's hand.

44. The method of claim 35, wherein the rules of the card game comprise standard five card poker hand ranking rules.

45. The method of claim 35, wherein each player receives one additional card when the play wager is made.

* * * * *

UNITED STATES PATENT AND TRADEMARK OFFICE

CERTIFICATE OF CORRECTION

PATENT NO. : 6,840,517 B2
APPLICATION NO. : 10/277508
DATED : January 11, 2005
INVENTOR(S) : Roger M. Snow and Ofir Ventura It is certified that error appears in the above-identified patent and that said Letters Patent is hereby corrected as shown below:

Column 14, line 54, please cancel X+cards; and insert the following:

X + 1 cards;

Signed and Sealed this

Twenty-third Day of January, 2007

JON W. DUDAS
*Director of the United States Patent and Trademark Office*